US005287547A

United States Patent [19]

Hidaka

[11] Patent Number: 5,287,547

[45] Date of Patent: Feb. 15, 1994

[54] TRANSMISSION AND RECEPTION SYSTEM

[75] Inventor: Hidenori Hidaka, Tokyo, Japan

[73] Assignee: Pioneer Electronic Corporation, Tokyo, Japan

[21] Appl. No.: 978,072

[22] Filed: Nov. 18, 1992

Related U.S. Application Data

[63] Continuation of Ser. No. 450,880, Dec. 14, 1989, abandoned.

[30] Foreign Application Priority Data

May 11, 1989 [JP] Japan ..... 1-116185

[51] Int. Cl.[5] ..... H04H 1/00

[52] U.S. Cl. ..... 455/4.2; 455/5.1; 455/6.3; 340/825.24; 381/11; 348/6

[58] Field of Search ..... 455/3.1, 3.3, 4.1, 4.2, 455/5.1, 6.1, 6.3, 38.1, 68, 42, 352, 353, 66; 340/310 CP, 310 R, 825.24, 825.25; 358/86, 93, 198; 381/11-12; 370/73

[56] References Cited

U.S. PATENT DOCUMENTS 4,787,085 11/1988 Suto et al. ..... 455/6.1
4,855,730 8/1989 Venners et al. ..... 340/825.24
4,862,159 8/1989 Marusa et al. ..... 340/825.24
4,885,803 12/1989 Hermann et al. ..... 455/603
4,897,714 1/1990 Ichise et al. ..... 455/5.1
4,935,924 6/1990 Baxter ..... 455/4
4,989,081 1/1991 Miyagawa et al. ..... 358/93

*Primary Examiner*—James L. Dwyer
*Assistant Examiner*—Andrew Faile
*Attorney, Agent, or Firm*—Sughrue, Mion, Zinn, Macpeak & Seas

[57] ABSTRACT

In a home bus system control signals and information signals are carried between a transmission station at one location and reception stations at other locations. There are plural signal sources at the transmitting station and plural types of signal formats, such as monaural and stereo or NTSC and HDS. A request signal sent from a receiving station identifies the signal source to be accessed and the signal format capability of a receiver at the receiver station. The request signal is decoded at the transmission station and causes transmission of an information signal from the selected signal source in the identified signal format.

10 Claims, 4 Drawing Sheets

TRANSMISSION AND RECEPTION SYSTEM

This is a continuation of application Ser. No. 07/450,880 filed Dec. 14, 1989 abandoned.

BACKGROUND OF THE INVENTION

The present invention relates to a transmission and reception system, and particularly relates to a transmission and reception system for performing transmission and reception of various types of signals through a transmission line.

A home bus system (hereinafter abbreviated to "HBS"), which is about to be put into practice, is a system in which carrier frequencies modulated with predetermined control signals are transmitted through a transmission line to remote locations where the modulated signals are supplied to controlled appliances, such as lighting fixtures or the like, provided inside a home so as to perform predetermined control of the controlled appliances by demodulating the modulated signals.

An HBS of this type is applicable to a system for transmitting and receiving information signals, such as an audio signal, a video signal, or the like, wherein, for example, an audio signal transmitting means is provided at one location, and a receiving means for receiving the audio signal is provided at another location.

In the case where the transmitted audio signal is a stereo signal and the receiving means has only a monaural capability, the system will not operate properly. The same is true of the reverse situation, and for that matter, it is true in any case where the signal type transmitted differs from the signal type for which the receiver is adapted.

In the case where the transmitting means is a television signal transmitting means which can transmit an HD television signal and the receiving means is a television receiver which can receive only an NTSC signal, it is impossible to receive the transmitted television signal by the receiving means because the television signal supplied to the receiver through a transmission line is an HD television signal.

SUMMARY OF THE INVENTION

It is therefore an object of the present invention to solve the foregoing problems in the prior art.

It is another object of the present invention to provide a transmission and reception system by which it is possible to supply a receiving means through a transmission line with an information signal which can be received by the receiving means.

In order to attain the foregoing objects, according to an aspect of the present invention, the transmission and reception system in which an information signal from a transmitting means provided at a first location is transmitted through a transmission line so as to be received by a receiving means provided at a second location, comprises: a transmission request signal output means provided at the second location for coding a transmission request signal and for sending out the coded transmission request signal onto the transmission line; a decoding means provided at the first location for receiving and decoding the transmission request signal; and an information signal output control means for causing the transmitting means to output an information signal corresponding to the output of the decoding means and receivable by the receiving means.

BRIEF DESCRIPTION OF THE DRAWINGS

Other features and advantages of the present invention will be apparent from the following description taken in connection with the accompanying drawings, wherein.

DETAILED DESCRIPTION OF THE INVENTION

Figure 1:
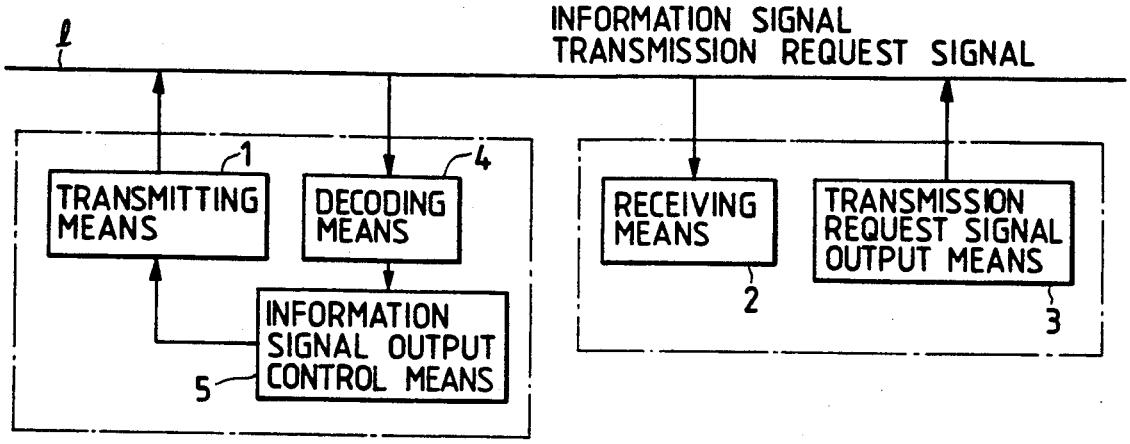
FIG. 1 is a diagram illustrating a basic configuration of the transmission and reception system according to the present invention.

First, referring to FIG. 1, the basic configuration of the transmission and reception system according to the present invention will be described hereunder. As shown in FIG. 1, the transmission and reception system in which an information signal from a transmitting means 1 provided at a first location is transmitted through a transmission line so as to be received by a receiving means 2 provided at a second location, comprises: a transmission request signal output means 3 provided at said second location for coding a transmission request signal and for sending out the coded transmission request signal onto the transmission line; a decoding means 4 provided at the first location for receiving and decoding the transmission request signal: and an information signal output control means 5 for causing the transmitting means to output an information signal compatible with the reception capability of the receiving means.

In the above-mentioned configuration, a transmission request signal is supplied from the transmission request signal output means 3 to the decoding means 4 through the transmission line 1. This transmission request signal is decoded in the decoding means 4, and the decoded output of the decoding means 4 is supplied to the information signal output control means 5. On the basis of the decoded output of the decoding means 4, the control means 5 causes the transmitting means 1 to output an information signal to the transmission line 1. At this time, the control means 5 controls the transmitting means 1 to cause the transmitting means 1 to output an information signal receivable by the receiving means 2.

The above-mentioned transmission request signal may include data for identifying a format or type of information signal receivable by the receiving means 2. The decoding means 4 decodes this identification data so that the transmitting means 1 is controlled by the control means 5 so as to output the above-mentioned receivable information signal.

Alternatively, the transmission request signal may include data for identifying the receiving means 2. In this case, the decoding means 4 decodes this identification data, and the decoded output of the decoding means 4 is put into the control means 5. In response to this decoded signal, the control means 5 controls the transmitting means 1 to output an information signal receivable by the receiving means 2 onto the transmission line 1.

Figure 2:
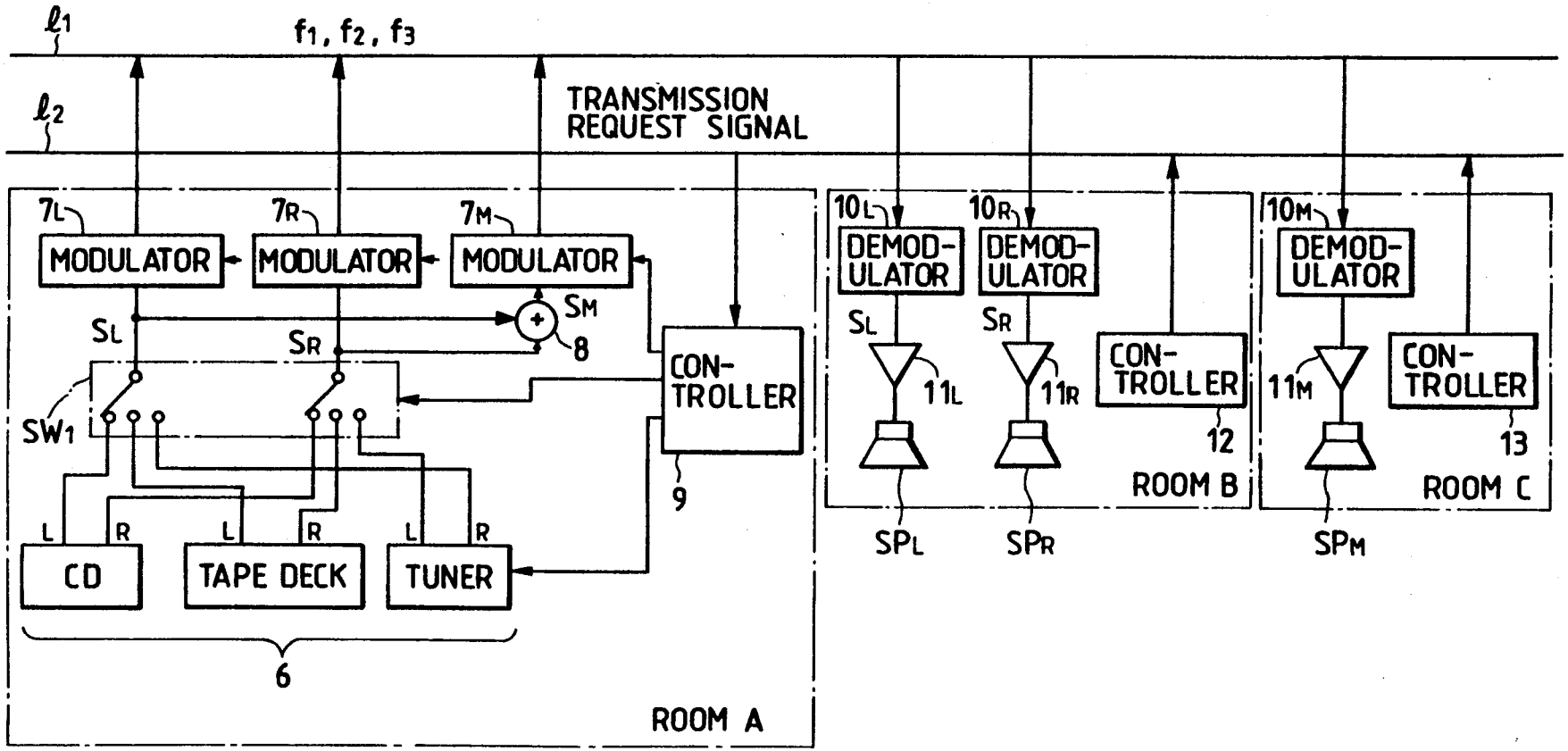
FIG. 2 is a diagram illustrating an embodiment of the transmission and reception system according to the present invention.

FIG. 2 shows an embodiment of the system for performing transmission and reception of an audio signal. In FIG. 2, a plurality of signal output units 6 such as a CD (compact disc) player, a tape deck, a tuner, and so on, are provided in a room A, and one of the signal output units 6 is selected by a function switch $SW_1$. Left and right stereo audio signals $S_L$ and $S_R$ supplied from the selected one of the signal output units 6 are supplied to modulators $7_L$ and $7_R$, respectively, in which carrier frequencies $f_1$ and $f_2$, different from each other, are modulated with the stereo audio signals $S_L$ and $S_R$, respectively.

On the other hand, the stereo audio signals $S_L$ and $S_R$ are added together by an adder 8 so that a monaural signal $S_M$ is outputted from the adder 8. The monaural signal $S_M$ is supplied to a modulator $7_M$, in which another carrier of a frequency $f_3$, different from the above-mentioned frequencies $f_1$ and $f_2$, is modulated with this monaural signal $S_M$.

In the room A, a controller 9 for controlling the modulators $7_L$, $7_R$ and $7_M$ is provided in addition to the signal output units 6 and the function switch $SW_1$.

In a room B, which is located separately from room A, demodulators $10_L$ and $10_R$ for demodulating the carriers $f_1$ and $f_2$ are provided so that demodulated signals therefrom, that is, the above-mentioned stereo audio signals $S_L$ and $S_R$, are supplied to amplifiers $11_L$ and $11_R$, respectively. The signals amplified by amplifiers $11_L$ and $11_R$ are supplied to a pair of speakers $SP_L$ and $SP_R$, respectively, so that a stereo signal is radiated from speakers $SP_L$ and $SP_R$. Additionally, a controller 12 is provided in the room B.

Further, in a room C, a demodulator $11_M$ for demodulating the modulated carrier $f_3$, and the demodulated output signal of the demodulator $11_M$, that is, the monaural audio signal $S_M$, is supplied to an amplifier $11_M$. The signal amplified by the amplifier $11_M$ is supplied to a speaker $SP_M$ so that a monaural signal is radiated from the speaker $SP_M$. Additionally, a controller 13 is provided in the room C.

The modulated carriers $f_1$, $f_2$ and $f_3$ are put out from the modulators $7_L$, $7_R$ and $7_M$ onto a transmission line $1_1$, such as a coaxial cable or the like, so that those carriers $f_1$, $f_2$ and $f_3$ are supplied to the demodulators $10_L$, $10_R$ and $10_M$ through the transmission line $1_1$.

Figure 3:
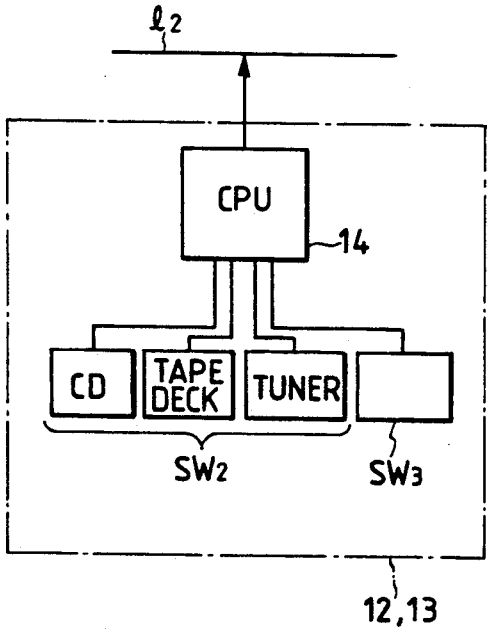
FIG. 3 is a diagram illustrating an example of the configuration of the controllers respectively provided in the rooms B and C in FIG. 2.
Figure 4:
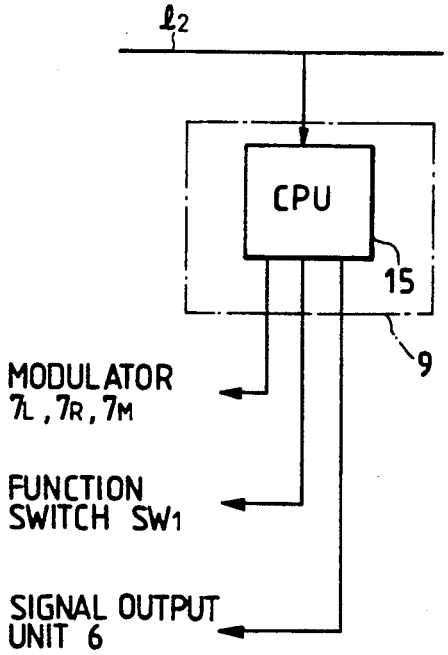
FIG. 4 is a diagram illustrating an example of the configuration of the controller provided in the room A in FIG. 2.

A transmission request signal is put out from each of the controllers 12 and 13 in the rooms B and C, and supplied to the controller 9 in the room A through a transmission line $1_1$. Each of the controllers 12 and 13, as shown in FIG. 3 has a CPU 14, an output unit selecting switch $SW_2$, and a transmission switch $SW_3$, the switches $SW_2$ and $SW_3$ being connected to the CPU 14. An internal memory of the CPU 14 of the controller 12 provided in the room B stores stereo signal identifying data, and an internal memory of the CPU 14 of the controller 13 provided in the room C stores monaural signal identifying data. On the other hand, the controller 9 provided in the room A, as shown in FIG. 4, has a CPU 15 for decoding the transmission request signals respectively generated from the controllers 12 and 13 and for supplying control signals to the signal output units 6, the function switch $SW_1$, and the modulators $7_L$, $7_R$ and $7_M$.

Figure 5:
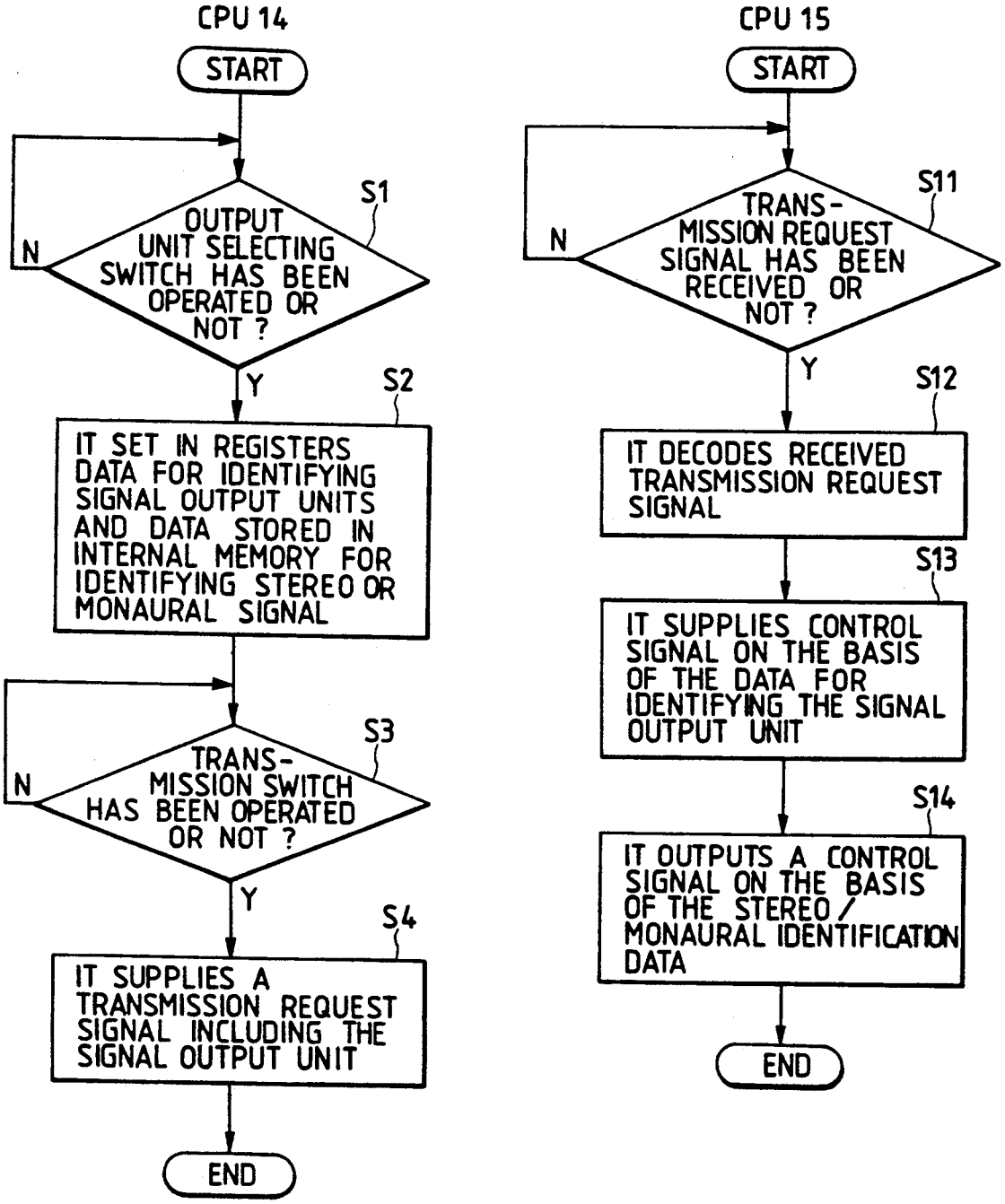
FIGS. 5 and 6 are different examples of flow charts showing the operations executed by the respective CPUs in FIGS. 3 and 4.

In the above-mentioned configuration, the operations executed by the CPUs 14 and 15 will be described with reference to the flow charts of FIG. 5.

First, the CPU 14 judges, in its first step S1, whether the output unit selecting switch $SW_2$ has been operated or not. If the switch $SW_2$ has been operated and hence the judgment shows "YES", the process of the CPU 14 is shifted into a step S2 in which the CPU 14 sets in its registers data for identifying the selected one of the signal output units 6 and data stored in its internal memory for identifying a stereo or monaural signal. Next, the process is shifted to a step S3 in which the CPU 14 judges whether the transmission switch $SW_3$ has been operated or not. If the switch $SW_3$ has been operated and hence the judgment shows "YES", the process is shifted to a step S4 in which the CPU 14 supplies the transmission line $1_2$ with a transmission request signal including the signal output unit identification data and stereo/monaural identification data set in the above-mentioned registers.

Next, the operation of the CPU 15 will be described. First, the CPU 15 judges whether the above-mentioned transmission request signal has been received or not in a step S11, and if the transmission request signal has been received and hence the judgment shows "YES", the process of the CPU 15 is shifted to a step S12 in which the CPU 15 decodes the received transmission request signal. Next, in a step S13, the CPU 15 supplies control signals to the selected signal output unit 6 and the function switch $SW_1$ on the basis of the data for identifying the signal output unit. By the control signals, the selected signal output unit 6 is actuated, and at the same time, the function switch $SW_1$ is changed over so that the output of the selected signal output unit 6 can pass through the function switch $SW_1$.

Next, the process of the CPU 15 is shifted to a step $S_{14}$ in which the CPU 15 outputs a control signal to the modulators $7_L$, $7_R$ and $7_M$ on the basis of the stereo/monaural identification data. If the control signal generated is in response to data for identifying a stereo signal, the modulators $7_L$ and $7_R$ are driven so as to modulate the carriers $f_1$ and $f_2$ with the stereo signals $S_L$ and $S_R$ and supply those modulated carrier signals onto the transmission line $1_1$. As a result, in the room B, the demodulators $10_L$ and $10_R$ demodulate the carrier signals $f_1$ and $f_2$ so that the stereo signals $S_L$ and $S_R$ supplied from the selected signal output unit 6 can be listened to from the speakers $SP_L$ and $SP_R$ after passing through the amplifiers $11_L$ and $11_R$. On the contrary, if the control signal generated is in response to data for identifying a monaural signal, the modulator $7_M$ is driven so as to modulate the carrier $f_3$ with the monaural signal $S_M$ from the adder 8 and to supply this modulated carrier signal onto the transmission line $1_1$. As a result, in the room C, the demodulator $10_M$ demodulates the modulated carrier signal $f_3$ so that the monaural signal $S_M$ supplied from the above-mentioned adder 8 can be listened to from the speaker $SP_M$ after passing through the amplifier $11_M$.

Figure 6:
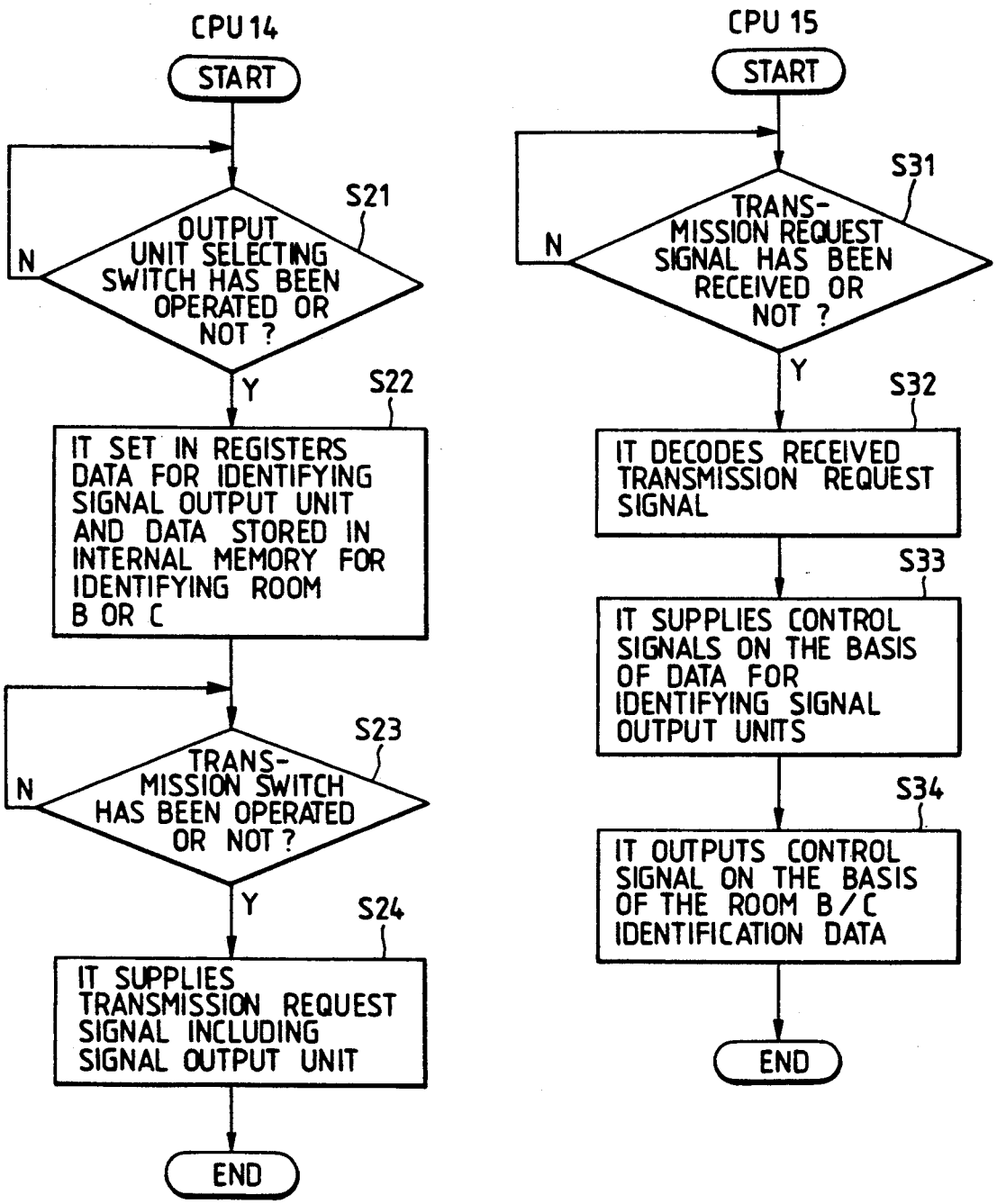

In the case where each room has only the capability for responding to a single type of signal, such as in the above case where room B has receivers for only stereo and room C has receivers for only monaural, the i.d. signal that is selected by the CPU 14 to control selection of the type of signal transmitted may be a room i.d. signal. An example of this is provided in the flow charts of FIG. 6.

First, the CPU 14 judges, in step S21, whether the output unit selecting switch $SW_2$ has been operated or not. If the switch $SW_2$ has been operated and hence the judgment shows "YES", the process of the CPU 14 is shifted into a step S22 in which the CPU 14 sets in its registers data for identifying the selected one of the signal output units 6 and data stored in its internal memory for identifying the room B or C. Next, the process is shifted to a step S23 in which the CPU 14 judges whether the transmission switch $SW_3$ has been operated or not. If the switch $SW_3$ has been operated and hence the judgment shows "YES", the process is shifted to a step S24 in which the CPU 14 supplies the transmission line $1_2$ with a transmission request signal including the signal output unit identification data and room B/C identification data set in the above-mentioned registers.

Next, the operation of the CPU 15 will be described. First, the CPU 15 judges whether the above-mentioned transmission request signal has been received or not in a step S31, and if the transmission request signal has been received and hence the judgment shows "YES", the process of the CPU 15 is shifted to a step S32 in which the CPU 15 decodes the received transmission request signal. Next, in a step S33, the CPU 15 supplies control signals to the selected signal output unit 6 and the function switch $SW_1$ on the basis of the data for identifying the signal output unit. By the control signals, the selected signal output unit 6 is actuated, and at the same time, the function switch $SW_1$ is changed over so that the output of the selected signal output unit 6 can pass through the function switch $SW_1$. Next, the process of the CPU 15 is shifted to a step S34 in which the CPU 15 outputs a control signal to the modulators $7_L$, $7_R$ and $7_M$ on the basis of the room B/C identification data.

If the control signal generated is in response to data for identifying the room B, the modulators $7_L$ and $7_R$ are driven so as to modulate the carriers $f_1$ and $f_2$ with the stereo signals $S_L$ and $S_R$ and to supply those modulated carrier signals onto the transmission line $1_1$. As a result, in the room B, the demodulators $10_L$ and $10_R$ demodulate the carrier signals $f_1$ and $f_2$ so that the stereo signals $S_L$ and $S_R$ supplied from the selected signal output unit 6 can be listened to from the speakers $SP_L$ and $SP_R$ after passing through the amplifiers $11_L$ and $11_R$.

On the contrary, if the control signal generated is in response to data for identifying the room C, the modulator $7_M$ is driven so as to modulate the carrier $f_3$ with the monaural signals $S_M$ from the adder 8 and to supply this modulated carrier signal onto the transmission line $1_1$. As a result, in the room C, the demodulator $10_M$ demodulates the modulated carrier signal $f_3$ so that the monaural signal $S_M$ supplied from the above-mentioned adder 8 can be listened to from the speaker $SP_M$ after passing through the amplifier $11_M$.

In the above-mentioned embodiments, each of the transmission request signals generated from the respective controllers 12 and 13 may include data for identifying the room A, or data for identifying the controller 2, so that the above-mentioned transmission request signals are accessed only by the controller 2 in the room A so as to be decoded therein.

Moreover, the carrier frequency $f_3$ of the monaural signal $S_M$ may be the same as the carrier frequency $f_1$ or $f_2$ of the stereo signal $S_L$ or $S_R$, and further the transmission lines $1_1$ and $1_2$ may be made a single transmission line through which both audio and transmission request signals can be transmitted.

Further, in addition to transmission control of stereo/monaural signals, the present invention is applicable to transmission control of color/black-and-white televisions, transmission control of Hi-Fi-audio/telephone signals transmission control of NTSC/HD television signals, and so on. For example, if a receiving side has a television receiver for receiving only an NTSC television signal in the case of transmission control of NTSC/HD TV signals, and when a transmission request signal is sent from the receiving side in question, an HD television signal is converted into an NTSC television signal on the transmitting side so that the converted NTSC television signal is transmitted to the receiving side.

As has been described above, according to the present invention, upon generation of a transmission request from a receiving means, a transmitting means can transmit to the receiving means an information signal receivable by the receiving means through a transmission line. It is therefore possible to perform optimum reception, and at the same time it is possible to provide effective use of a transmission line.

What is claimed is:

1. A transmission and reception system in which an information signal from a transmitting means provided at a first location transmitting station of the transmission and reception system is transmitted through a transmission line so as to be received by a receiving means provided at a second location receiving station of the transmission and reception system, said transmitting station including a plurality of signal sources and a controller which selects amongst said sources and activates control functions of said sources, said system comprising:

a transmission request signal output means provided at said receiving station for placing on said transmission line for transmission to said transmitting station a coded transmission request signal including data identifying a type and a form of information signal receivable by said receiving means at said receiving station;

a decoding means provided in said controller at said transmitting station for receiving and decoding said transmission request signal; and an information signal output control means also provided in said controller at said transmitting station, responsive to the output of said decoding means, for causing said transmitting means to output to said transmission line said type and format of information signal receivable by said receiving means.

2. A system as claimed in claim 1, wherein said data identifying said type of signal directly identifies a type of signal receivable by said receiving means.

3. A system as claimed in claim 1, wherein said data identifying said type of signal further comprises data identifying the receiving means associated with the transmission request signal, and wherein said decoding means further comprises means, responsive to said receiving means identifying data, for providing a signal which enables said information control means to output said type of information signal receivable by said receiving means.

4. A transmission and reception system for transmitting data and source information at predetermined frequencies between an information transmission station at a first location and at least one information reception station at a second location, said transmission station including a plurality of signal sources and a controller which selects amongst said sources and activates control functions of said sources, said system comprising:

transmission means at said information transmission station for selectively outputting source information of a single type in at least two different signal formats;

a transmission line connected between said information transmission and information reception station, whereby signal formats output by said transmission means are carried by said transmission line;

receiving means at said information reception station adapted for receiving said source information in one of said signal formats;

receiving station control means at said information reception station for providing a transmission request signal which at least requests transmission of said source information and identifies a signal format capability of said receiver means, said request signal being carried by said transmission line from said information reception station to said information transmission station; and transmission station control means included in said controller at said information transmission station responsive to said request signal for causing said transmission means to output said source information in said one signal format.

5. A system as claimed in claim 4, wherein said transmission means comprises:

plural signal sources, plural modulators, and switch means for selectively connecting the outputs from said plural signal sources to said plural modulators, the outputs of said modulators being connected to said transmission line;

and wherein said transmission station control means comprises means for selectively enabling selected ones of said plural signal sources, said plural modulators, and said switch means in accordance with data in said transmission request signal.

6. A system as claimed in claim 5, wherein said receiver station control means further comprises a source selection switch for selecting one of said plural signal sources, and a controller means responsive to said source selection switch for generating said transmission request signal and including therein an identification of said source selected by said source selection switch, said signal format capability, and a request for transmission.

7. A system as claimed in claim 4, wherein said at least two different signal formats include audio monaural and audio stereo formats.

8. A system as claimed in claim 4, wherein said transmission line comprises a single cable for carrying information and data signals in both directions.

9. A system as claimed in claim 4, wherein said transmission line comprises a first cable for carrying information signals from said information transmitting station to said information reception station, and a second cable for carrying data signals from said information reception station to said information transmission station.

10. A home bus system for transmitting entertainment source information at predetermined frequencies from plural signal sources located at a transmitting station to receivers located at receiving stations located in separate locations from said transmitting station, said transmitting station also including a controller which selects amongst said sources and activates control functions of said sources, said system comprising means associated with said receivers for generating a request signal identifying a selected signal source and a signal format to be sent to an associated receiver, and means included in said controller responsive to said request signal for selecting and enabling said selected signal source identified in said request signal and for causing a signal therefrom to be transmitted to said receiver in accordance with said signal format identified in said request signal.

* * * * *